US005119505A

United States Patent [19]

Tisseront et al.

[11] Patent Number: 5,119,505

[45] Date of Patent: Jun. 2, 1992

[54] PROTECTIVE HELMET WITH REMOVABLE PROTECTIVE LINING FOR CUSHIONING RADIO CIRCUITRY

[76] Inventors: André Tisseront, 2, Impasse de la Papeterie; Hervé Tisseront, 7ter rue Adolphe Thiers, both of F-10000 Troyes, France

[21] Appl. No.: 565,485

[22] Filed: Aug. 10, 1990

[30] Foreign Application Priority Data

Aug. 11, 1989 [EP] European Pat. Off. ..... 89114938

[51] Int. Cl.[5] ..... H04B 1/38; H04B 1/08

[52] U.S. Cl. ..... 455/89; 455/90; 455/350

[58] Field of Search ..... 455/350, 351, 89, 90; 2/414, 415; 181/128, 129, 242; 381/86

[56] References Cited

U.S. PATENT DOCUMENTS

| | | | |
|---|---|---|---|
| 4,130,803 | 12/1978 | Thompson . | |
| 4,152,553 | 5/1979 | White . | |
| 4,424,880 | 1/1984 | Murayama et al. | 181/129 |
| 4,473,130 | 9/1984 | Korber et al. | 181/128 |
| 4,475,248 | 10/1984 | L'Abbe et al. | 2/2.5 |
| 4,524,461 | 6/1985 | Kostanty . | |
| 4,945,458 | 7/1990 | Batts et al. | 2/5 |

FOREIGN PATENT DOCUMENTS

| | | |
|---|---|---|
| 2547372 | 4/1977 | Fed. Rep. of Germany . |
| 2829482 | 7/1978 | Fed. Rep. of Germany . |
| 3329767 | 8/1983 | Fed. Rep. of Germany . |

OTHER PUBLICATIONS

Research Disclosure, No. 206, Jun. 1981, "Safety Helmet".

*Primary Examiner*—Reinhard J. Eisenzopf
*Assistant Examiner*—Lisa Charouel
*Attorney, Agent, or Firm*—William H. Eilberg

[57] ABSTRACT

Described is a protective helmet comprising an impact-resistant outer helmet shell into which a head padding (10) is removably inserted as separate inner helmet shell. The protective helmet is provided with radiotelephone equipment. With the exception of a microphone and possibly an on/off switch and a battery charge check indicator all the parts of the radiotelephone equipment are provided in recesses (32*a* 32*b*, 36–46) provided for them in the head padding (10) at the back at the rear side and at the lower peripheral edge thereof. The two recesses (36, 46) for the two loudspeakers are connected via acoustic passages formed in the head padding (10) to an acoustic cavity provided at ear level. As a result, in the temple and ear region the protective helmet is free from any metal or plastic parts which might cause injury in the event of an impact. In addition, the position of the radiotelephone equipment is chosen so that the equilibrium of the protective helmet is practically not impaired.

17 Claims, 6 Drawing Sheets

Figure 1:
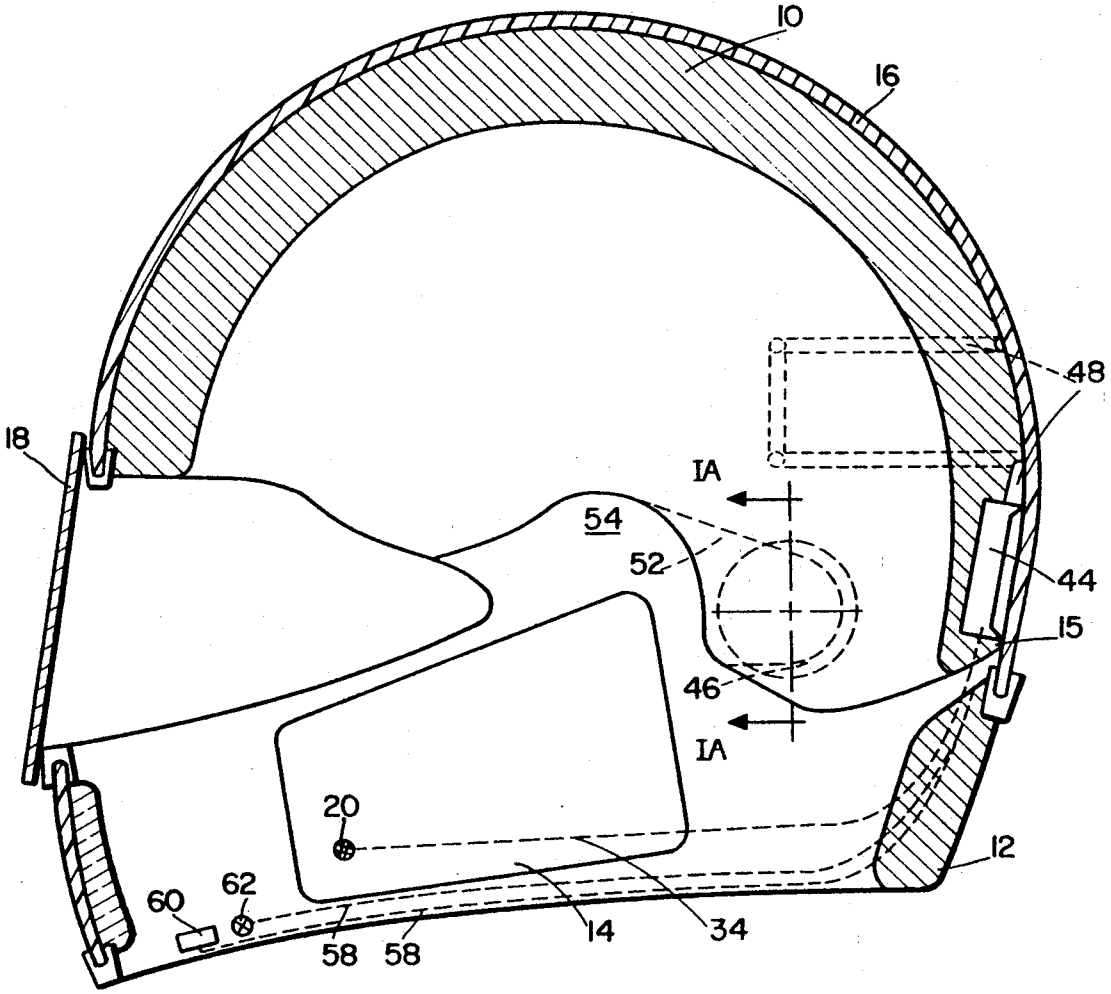

PROTECTIVE HELMET WITH REMOVABLE PROTECTIVE LINING FOR CUSHIONING RADIO CIRCUITRY

DESCRIPTION

The invention relates to a protective helmet comprising an impact-resistant outer helmet shell, a protective padding arranged on the inner side of the outer helmet shell and consisting of head, neck and chin pads, recesses which are provided in the protective padding, are directed outwardly and are covered towards the helmet interior by a remaining protective padding layer and in which as parts of a radio-telephone system at least one electronic receiving section, a loudspeaker and a power supply battery are accommodated, and a radio antenna provided on the outer surface of the protective padding.

Such protective helmets or safety helmets are used for example in driving schools, firstly to prevent head injuries of the motorbicycle learner in the event of a traffic accident or the like and secondly to give the driving instructor the possibility of giving the learner instructions during the training. Furthermore, such protective helmets or crash helmets are used in all types of motor sport, in mountaineering, parachuting, skiing and in any other type of sport where a helmet is required. Such protective helmets are moreover suitable for use in industry for workers who have to perform dangerous work in noisy environment and must remain in contact with supervising personnel in a control centre or the like.

In the known protective helmet of the type mentioned at the beginning (DE-GM 7,736,284) the outer helmet shell is equipped with neck pads and chin supports and in one of said chin supports at ear level a recess is provided into which a loudspeaker is embedded. From the point of view of safety this position of the loudspeaker is extremely problematical because in the event of a lateral blow on the protective helmet the wearer thereof may be injured by the loudspeaker. Furthermore, behind the same chin support a battery is held by means of an elastic loop and covered. Since this battery is practically likewise at ear level it also represents a safety problem because it impairs the protective effect of the helmet in the same manner as the loudspeaker. Furthermore, in the known protective helmet the inner helmet shell is obviously fixedly connected to the outer helmet shell and separable from the latter only with difficulty because the recess provided as battery compartment is covered with respect to the helmet interior by a plate which can be removed or pivoted outwardly. This involves a further safety problem because this plate can be lost or the protective helmet wearer may forget to close this plate, thereby drastically intensifying the safety problem which the battery itself represents. Finally, in the known helmet not only the recess for the loudspeaker but also the recess for the electronic receiving section is provided at ear level and thus laterally in the protective padding. This arrangement may suffice in order to avoid subjectively noticeably changing the weight distribution of the protective helmet, which is the objective, but nevertheless objectively no doubt does change the weight distribution and causes at least the same intensifying of the safety problem as due to the battery arrangement. These lateral parts, where in the known protective helmet loudspeaker, battery and receiving section are accommodated, are the most sensitive points from the point of view of safety because in an accident the helmet very frequently suffers impacts at these points.

In a known crash helmet for motorbicycle riders (DE-A1-2,547,372) stereo headphones are arranged between the outer shell of the helmet and the inner lining thereof consisting of foamed material. The stereo headphones are connected to an electrical connector socket disposed on the crash helmet. A cable is inserted into the socket. The transmitting device connected to the cable, in particular a cassette recorder, is mounted on the crash helmet or on the motorcycle. The stereo headphones mounted on the inner side of the outer helmet shell at ear level result in the same safety problem as the loudspeakers in the known protective helmet described above. Another disadvantage is that the transmitting device disposed outside the crash helmet requires connecting lines through the outer helmet shell to the stereo headphones, these weakening the outer helmet shell.

A further known motorcycle protective helmet with built-in ear-pieces for connection to a cassette recorder (DE-A1-2,829,482) mounted on the motorcycle differs from the known protective helmet described above only in that the ear-pieces are not arranged between the outer shell and the inner lining but inserted in recesses of a rubber-elastic helmet lining, covered by a cloth-like screen and by fixed connecting lines connected to two connecting sockets in the helmet into which for detachable electrical connection of the ear-pieces to the cassette recorder two plug connectors attached to the ends of a flexible connecting cable can be inserted. This known motorcycle protective helmet thus involves the same safety problems as the previously described known protective helmet In a further known protective helmet for motorcycle riders (EP-A2-0 076 946) the safety problem caused by the loudspeakers or headphones is avoided in that in their place flexible ear-pieces are merely provided and are secured at ear level to the inside of the padding of the helmet or integrated as acoustic horn into the padding of the helmet. An acoustic line attached to the inner side of the protective helmet opens at one end into the ear or mouth region of the helmet and the end of the line disposed outside the protective helmet is provided with a coupling for connection to a further acoustic line. The communication means of said protective helmet is suitable only for persons riding together on one and the same motorcycle because their helmets must be connected together by the acoustic line. If as communication means a radiotelephone system were used, and thus instead of the ear-pieces the usual miniature loudspeakers or headphones, the same safety problems would be encountered as in the known helmets described above.

Finally, a carrier having a telephone speaking means (DE-C2-3,043,030) and intended generally for helmets is known which can be mounted in removable manner on helmets and has a microphone, an audioreceiver or earphone and an amplifier with associated battery as well as means for an electrical and/or inductive connection of said parts with each other for permitting several users to communicate with each other. The use of this carrier in a protective helmet leads to the same safety problems as encountered in the first known protective helmet described because the earphones come to lie at the level of the ears of the wearer. For the use of this known carrier the outer helmet shell and the padding must obviously be made integrally because the carrier is provided with ribs adapted to fit into corresponding seats which are provided between the outer shell of the helmet and a part of the edge of the padding made integrally with the outer shell.

The problem underlying the invention is to improve a protective helmet of the type mentioned at the beginning in such a manner that the safety problems which are encountered in the known helmets and some of which have been outlined above ar eliminated.

Proceeding from a protective helmet of the type mentioned at the beginning this problem is solved according to the invention in that the head padding is formed as separate inner helmet shell which is inserted removably into the outer helmet shell, that all the recesses with the radiotelephone equipment are provided in the head padding, behind at the rear side of the head padding and at the lower peripheral edge thereof, and that the or each loudspeaker recess is connected via an acoustic passage formed in the head padding to an acoustic cavity which is provided laterally at or in the head padding for the ear.

With the protective helmet according to the invention for maintaining the radiotelephone equipment, in particular for replacing the power supply battery, the head padding can be removed as separate inner helmet shell from the outer helmet shell. This eliminates the necessity of removable or pivotal plates for covering the recess serving as battery compartment and thus also the safety hazard involved. Since in the protective helmet according to the invention all the electronic and acoustic parts as well as the power supply are integrated into the head padding at the back in the rear side thereof and at the lower peripheral edge thereof and are thus arranged beneath and behind the ears, the equilibrium of the helmet remains objectively and subjectively unchanged and, the most important point, at ear level and thus in the lateral region of the protective padding there are no mechanical parts which might cause injury in the event of a lateral impact on the helmet in the region of the ears or temples. The acoustic passage is expediently simply a corresponding tubular cutout in the head padding which permits an excellent acoustic transmission to the ears without presenting any safety problem at all. The positioning of the loudspeaker according to the invention in conjunction with the acoustic passage thus has the particular advantage that in the event of a blow on the helmet no metal or plastic parts are present at the level of the ears or temples. Since the entire radiotelephone equipment is integrated into the protective padding no connecting lines which could weaken the outer helmet shell need be led through said outer helmet shell either.

Advantageous further developments of the invention are set forth in the subsidiary claims.

The head padding formed as separate inner helmet shell need not be made in one piece. Depending upon the form of the outer helmet shell it may be expedient to make the inner helmet shell in one or several parts. With a multipart form the inner helmet shell is expediently divided in such a manner that the smaller portion or the smaller portions each have a recess with a loudspeaker, the electrical connection of said loudspeaker or said loudspeakers to the remaining radio equipment in the larger portion of the head padding then being effected via thin flexible electrical lines or leads.

At the rear side of the head padding at the lower edge thereof the recesses for the radio equipment are distributed in such a manner that the head padding remains in equilibrium in every direction. For the same reason the antenna is formed as sheet or frame antenna and arranged symmetrically to the vertical longitudinal section centre plane of the head padding.

Irrespective of whether in the protective helmet according to the invention the acoustic cavity is formed as recess provided laterally at the lower peripheral edge of the head padding and leaving the ear free or as cut-out depression in the inner wall of the head padding at ear level, in the region of the ear of the helmet wearer there is no part of the radiotelephone equipment which might cause injury.

If the radiotelephone equipment includes a transmitting-receiving section the necessary microphone is provided at or in the neck pad and/or chin pad. This therefore requires no change at all of the head padding and also no compromise whatever regarding the safety standard thereof.

The sole passages through the outer helmet shell which may be necessary at all in the protective helmet according to the invention are bores which can be made sufficiently small in the chin region of the protective helmet for provision of a battery charge check indicator or an on/off switch. For a particularly high safety standard these parts of the equipment can be omitted. In this case the electronics of the radiotelephone equipment is provided with a rest circuit which is activatable by speech of the person wearing the protective helmet or from outside by the corresponding transmitter.

Expediently, the inner helmet shell is made of polystyrene, i.e. a light plastic material particularly suitable for making moulded parts.

Figure 2:
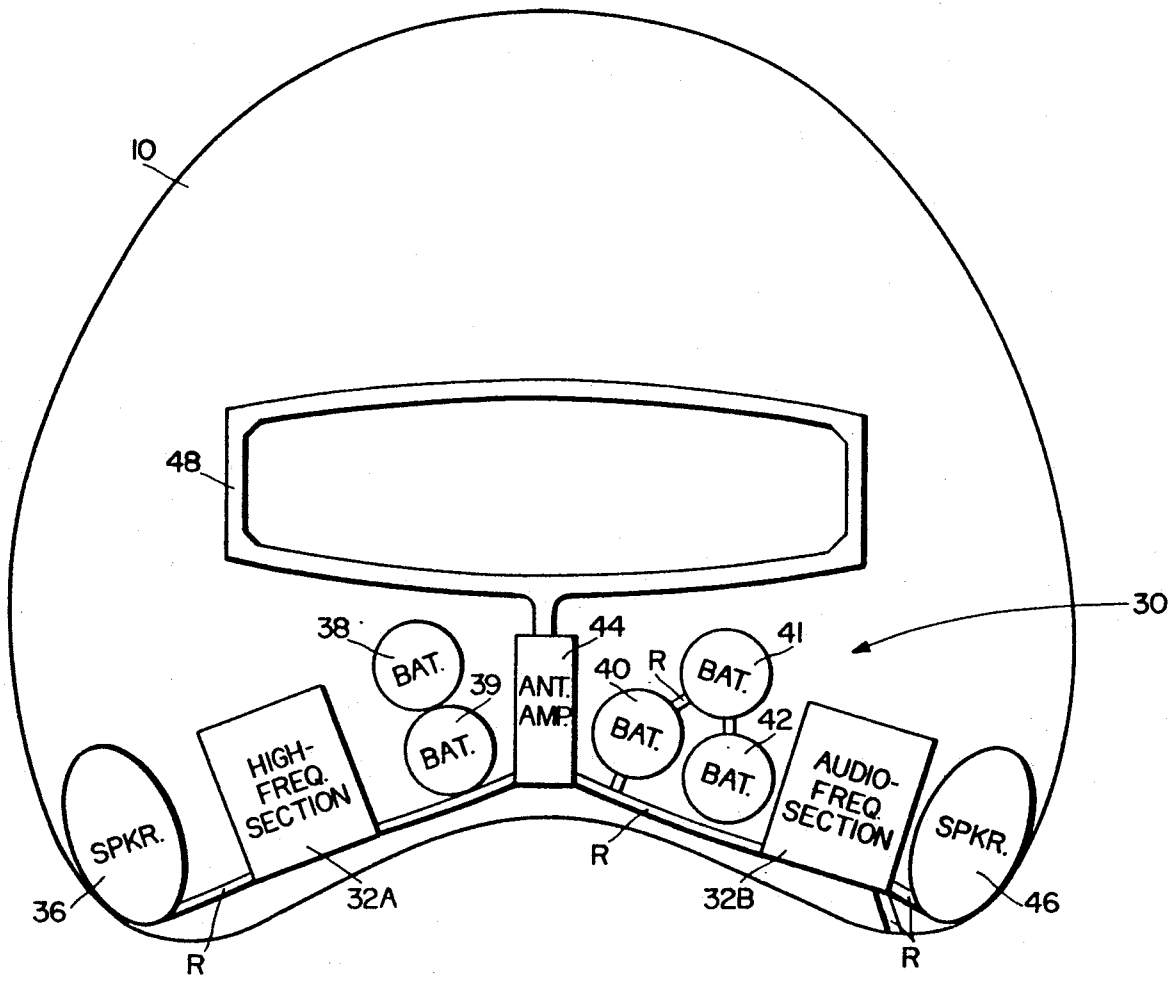
Figure 3:
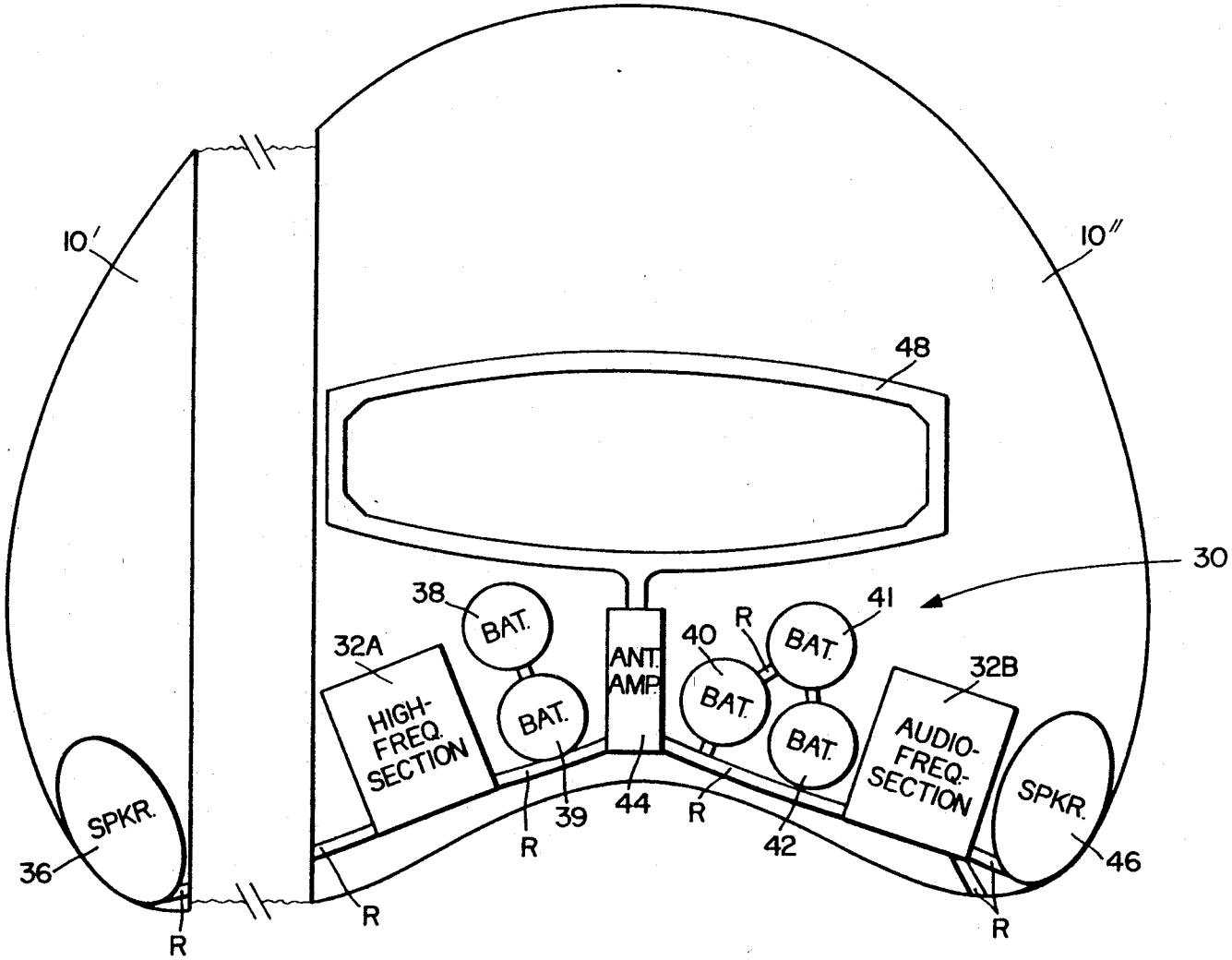
Figure 4:
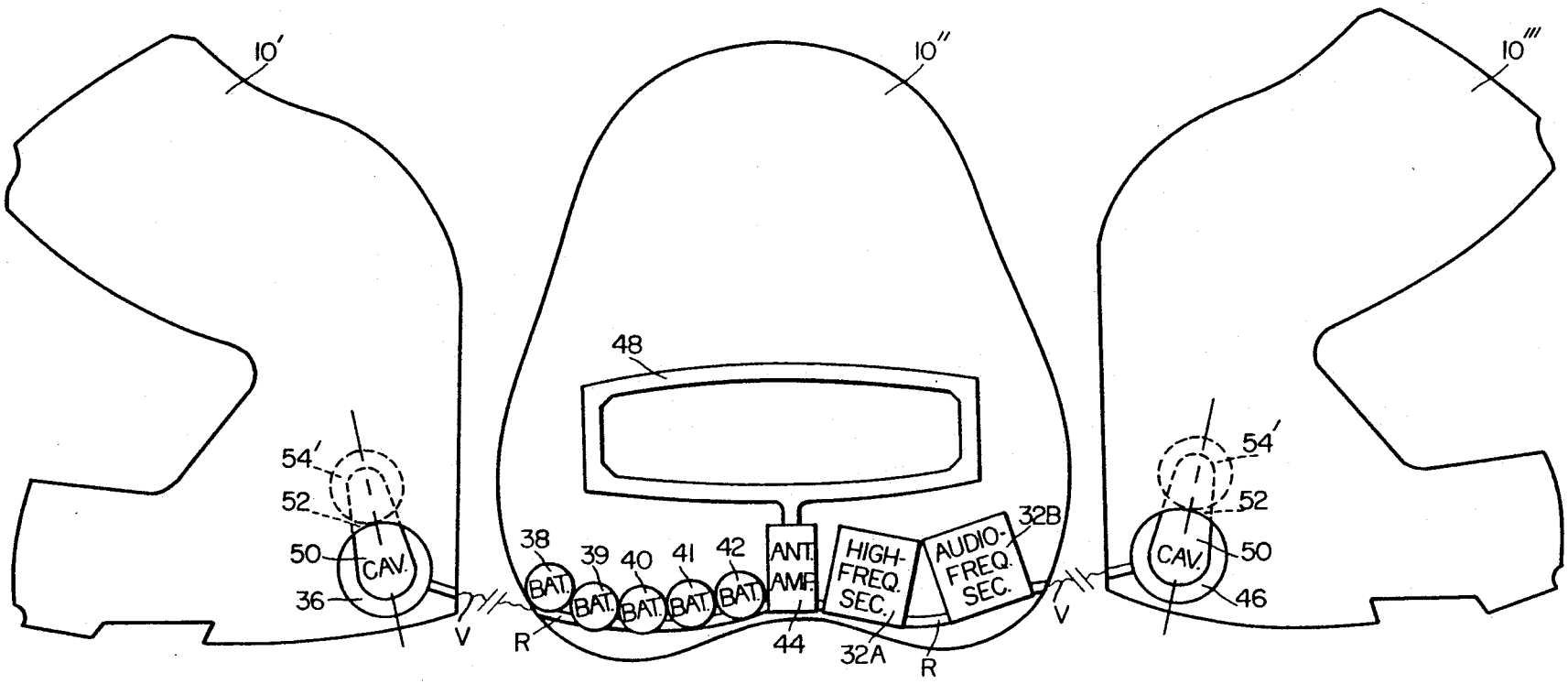
Figure 5:
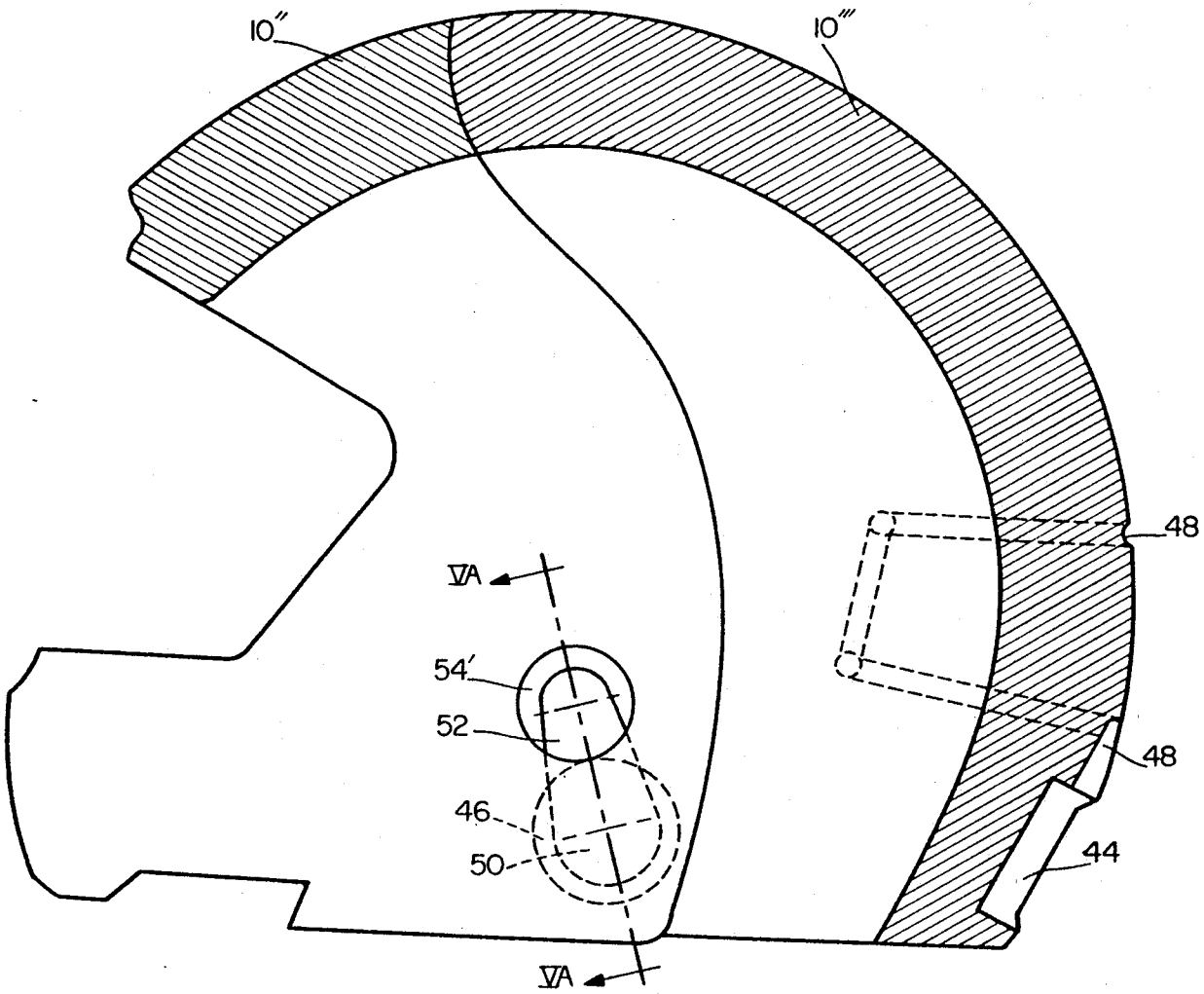
Figure 6:
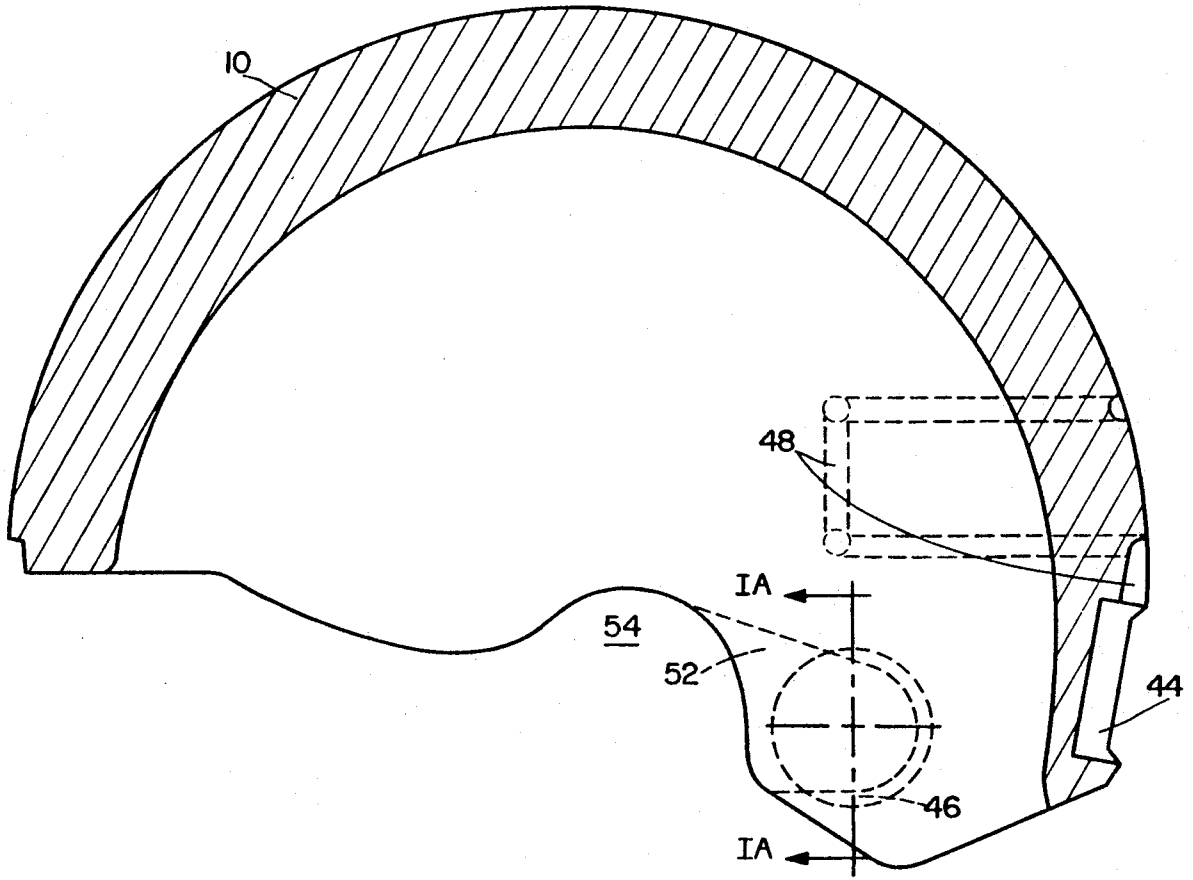
Figure 5A:
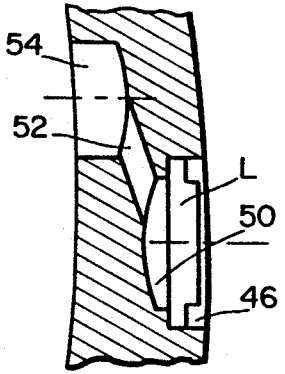
Figure 1A:
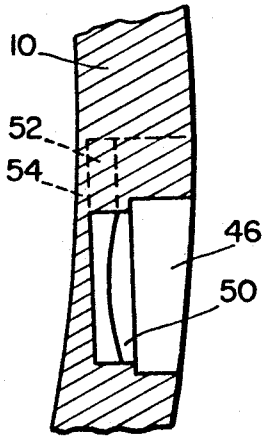

Examples of embodiment of the invention will be described in detail hereinafter with reference to the drawings, wherein:

FIG. 1 shows in a vertical longitudinal section a first embodiment of the protective helmet according to the invention with one-part head padding, FIG. 1*a* is an enlarged detail of the head padding in section along the line Ia—Ia of FIG. 1, FIG. 2 is a rear view of the head padding of the protective helmet according to FIG. 1, the outer helmet shell having been omitted for clarity from this Figure and all further Figures, FIG. 3 is a rear view of a two-part head padding of a second embodiment of the protective helmet according to the invention, FIG. 4 shows in rear and side view a three-part head padding of a third embodiment of the protective helmet according to the invention, FIG. 5 shows in vertical longitudinal sectional view the assembled three-part head padding according to FIG. 4, FIG. 5*a* shows in an enlarged illustration a detail of the head padding in section along the line Va—Va of FIG. 5, and FIG. 6 as a detail the head padding of FIG. 1.

In FIG. 1 a first embodiment of a protective helmet is shown complete in a vertical longitudinal sectional view, i.e. not only its head padding 10 but also all the remaining parts, whereas in the further Figures in each case only the head padding and the parts integrated thereinto of a radiotelephone system denoted as a whole by 30 are shown. The protective helmet illustrated in FIG. 1 is a so-called integral helmet as used as crash helmet by motorcyclists. This is however only one use of the protective helmet described by way of example because said helmet can also be used for other purposes, some examples of which are enumerated in the introduction to the description.

The protective helmet according to FIG. 1 has an impact-resistant outer helmet shell 16 which comprises between the chin and forehead region an opening which is covered by means of a pivotal transparent visor flap 18. On the inner side of the outer helmet shell 16 a protective padding is arranged which consists of the head pad or padding 10, a neck pad 12 and a chin pad 14.

The head padding 10 illustrated in FIG. 1 and 6 in section and in FIG. 2 as a detail in a rear view, is formed as a separate inner helmet shell which is removably inserted into the outer helmet shell 16 in accordance with the illustration of FIG. 1. The complete radiotelephone equipment 30 is integrated into the head padding 10 with the exception of a microphone 20 which is mounted on or in the chin pad 14. When the radiotelephone equipment 30 is designed only for reception an electronic receiving section suffices. When the radiotelephone equipment 30, as in the case illustrated, is designed for transmission and reception and the microphone 20 is thus present the radiotelephone equipment comprises an electronic transmitting-receiving section 32. The microphone 20 is connected to the remaining radiophonic equipment 30 in the head padding 10 via a flexible electrical line 34 which is indicated in FIG. 1 in dashed line.

In accordance with the illustration in FIG. 2 the head padding 10 comprises a plurality of outwardly directed recesses which are covered towards the helmet interior by a remaining padding layer and in which the remaining radiotelephone equipment is accommodated. Hereinafter reference numerals will be given only for the recesses. The recesses illustrated may however also be regarded as the parts of the radiotelephone equipment accommodated therein, thereby simplifying the description.

The recesses are from left to right in the illustration of FIG. 2, a recess 36 for a left loudspeaker, a recess 32*a* for the HF section of the electronic transmitting-receiving section 32, recesses 38 and 39 for power supply batteries, a recess 44 for an antenna amplifier of the electronic transmitting-receiving section 32, recesses 40, 41 and 42 for further power supply batteries, a recess 32*b* for the AF section of the electronic transmitting-receiving section 32 and a recess 46 for a right loudspeaker. These recesses are connected by shallow grooves R in which electrical connecting lines are laid which are not shown in detail. Above the recess 44 there is a substantially rectangular outwardly open recess 48 which is formed as shallow groove and provided for a frame antenna. With the exception of the somewhat higher located recess 48 for the frame antenna all the recesses on the head padding 10 are provided at the back at the rear side thereof and at the lower peripheral edge 15 thereof. The head padding 10 consists of polystyrene. In the formation of the head padding as separate inner helmet shell the recesses described above are also formed but they may also be subsequently worked into the head padding 10.

In accordance with the illustration in FIG. 1*a*, which shows a section along the line Ia—Ia of FIG. 1, a resonance cavity 50 adjoins the loudspeaker recess 46 towards the helmet interior and is connected via an acoustic passage 52, which is likewise left free in the head padding 10, to an acoustic cavity 54 which is provided in FIG. 1 laterally on the head padding for the ear (not shown). In this case the acoustic cavity 54 is a cutout which is provided laterally at the lower peripheral edge of the head padding 10 and leaves the ear free. In contrast, in the case illustrated in FIG. 5 the acoustic cavity 54' is a depression let at ear level into the inner wall of the head padding, as will be discussed in further detail below. A resonance cavity 50 an an acoustic passage 52 of the aforementioned type are of course also associated with the left loudspeaker recess 36.

In the example of embodiment illustrated in FIG. 2 the head padding 10 consists of one part. FIG. 3 shows for a second embodiment of the protective helmet according to the invention a head padding 10 which consists of two parts 10' and 10'' which are different in size and can be assembled in the outer helmet shell 16 to give the inner helmet shell. The head padding 10 is divided in such a manner that the smaller portion 10' covers only the ear region thereof including the left loudspeaker recess 36.

In the case shown in FIGS. 4 and 5 the head padding 10 for a third embodiment of the protective helmet consists of three portions, that is of two smaller portions 10' and 10''' and a larger portion 10''. The head padding 10 is divided in such a manner that the two smaller portions 10' and 10''' cover only the left and right ear regions thereof including respectively the left loudspeaker recess 36 and the right loudspeaker recess 46. Flexible electrical lines V via which the loudspeakers are connected to the remaining radiotelephone equipment in the larger portion 10'' are once again only indicated in FIG. 4.

In accordance with the illustration of FIG. 5*a*, showing a section along the line Va—Va of FIG. 5, the acoustic cavity 54' connected via the acoustic passage 52 to the resonance cavity 50 is a circular depression in the inner side of the head padding 10. In FIG. 5*a* the right loudspeaker L is also indicated as flat capsule-like loudspeaker.

As mentioned, between the loudspeaker cutouts 36, 46 the remaining recesses with the remaining parts of the radiotelephone equipment are distributed in such a manner that the head padding 10 is in equilibrium in every direction.

The distribution can be as in FIG. 2 or as in FIG. 4, i.e. some of the power supply batteries (38 and 39) can be on the one side and some of the power supply batteries (40–42) on the other side of the vertical longitudinal sectional centre plane of the head padding 10 or all of the power supply batteries may be on one side of said plane and the HF section 32*a* and the AF section 32*b* may be provided on the other side of said plane.

The radiotelephone equipment accommodated in the head padding 10 is connected via flexible electrical lines 58 to a switch 60 and a battery charge check indicator 62 at the outer helmet shell 16 as is shown only schematically in dashed lines in FIG. 1.

As power supply batteries, in the protective helmet illustrated five nickel-cadmium button cells are employed.

The antenna may be simply a sheet antenna placed onto the outer surface of the head padding, the groove-shaped recess 48 then being superfluous.

The outer helmet shell 16 preferably consists of polycarbonate or Kevlar.

What we claim is:

1. A protective helmet, comprising:

(a) an impact-resistant outer helmet shell (16), (b) a protective padding arranged on the inner side of the outer helmet shell (16) and consisting of a plurality of separate pieces, the padding having an outer side adapted to adjoin the outer helmet shell, the padding having an inner side adapted to adjoin a user's head, the protective padding being formed as a separate inner helmet shell which is inserted removably into the outer helmet shell (16), (c) a plurality of recesses integrally formed in the outer side of the protective padding, the recesses extending only through part of the thickness of the protective padding, wherein there remains a layer of protective padding between each recess and the inner side of the padding, (d) a radio-telephone system (30) having components including at least an electronic receiving section, a loudspeaker and a power supply battery, the components of the radio-telephone system being located within said recesses in said protective padding, the radio-telephone system also including a radio antenna provided on the outer surface of the protective padding, the loudspeaker, battery, and antenna being operatively connected to the electronic receiving section, (e) wherein all the recesses (32*a*, 32*b*, 36–46) containing the components of the radiotelephone equipment (30) are located towards the rear of the protective padding, and at the lower peripheral edge (15) thereof, wherein the recess which contains the loudspeaker is disposed at a level below that of the user's ear, and (f) wherein the loudspeaker recess (36, 46) is connected via an acoustic passage (52) defined by the protective padding to an acoustic cavity (54, 54') which is provided for the ear and which is also defined by the protective padding.

2. The helmet of claim 1, wherein there are two recesses (36, 46) for two loudspeakers.

3. The helmet of claim 1, wherein the padding comprises a single piece.

4. The helmet of claim 1, wherein the padding comprises two portions (10', 10'') of different size adapted to be assembled together in the outer helmet shell (16).

5. The helmet of claim 4, wherein the padding is divided in such a manner that the smaller portion (10') covers only the ear region thereof including a recess (36) with a loudspeaker.

6. The helmet of claim 2, wherein the padding comprises three portions (10', 10'', 10''') adapted to be assembled in the outer helmet shell (16), wherein there are two smaller portions and one larger portion.

7. The helmet of claim 6, wherein the padding is divided in such a manner that the two smaller portions (10', 10''') cover only the left and right ear region thereof including the two loudspeaker recesses (36, 46) with the left and right loudspeaker respectively.

8. The helmet of claim 2, wherein the recesses located between the loudspeaker recesses (36, 46) are distributed in such a manner that the padding is in equilibrium in every direction.

9. The helmet of claim 1, wherein the antenna is a frame antenna which is arranged in a shallow recess which is symmetric around a vertical longitudinal sectional center plane of the padding.

10. The helmet of claim 1, wherein the antenna is placed as a sheet or foil onto the outer side of the padding symmetrically to a vertical longitudinal sectional center plane of the padding.

11. The helmet of claim 8, wherein there are a plurality of recesses (38–42) with power supply batteries disposed therein, and wherein the padding is balanced by the position of said batteries with respect to a vertical longitudinal sectional center plane.

12. The helmet of claim 3, wherein the acoustic cavity (54) is a cutout provided laterally at the lower peripheral edge of the padding and leaving the ear free.

13. The helmet of claim 6, wherein the acoustic cavity (54') comprises a depression left free at ear level in the inner wall of the smaller padding portions (10', 10''').

14. The helmet of claim 1, wherein there is a resonance cavity (50) adjoining each loudspeaker recess (36, 46) from which the acoustic passage (52) leads to the acoustic cavity (54, 54').

15. The helmet of claim 1, wherein the radio-telephone system (30) comprises at least one microphone (20) at or in a neck pad and/or chin pad (12, 14), the microphone being connected by flexible electrical lines (34) to other components of the radio-telephone system.

16. The helmet of claim 1, wherein the radio-telephone system is connected via flexible electrical lines (58) to a switch (60) and/or a battery charge check indicator (62) at the outer helmet shell (16).

17. The helmet of claim 1, wherein the padding comprises polystyrene and the outer helmet shell is made of a material selected from the group consisting of polycarbonate and Kevlar.

* * * * *